US007103190B2

(12) United States Patent
Johnson et al.

(10) Patent No.: US 7,103,190 B2
(45) Date of Patent: Sep. 5, 2006

(54) ACOUSTIC DEVICE

(75) Inventors: David Johnson, Kilnwick (GB); William John Metheringham, Roos (GB)

(73) Assignee: Newlands Technology Limited, (GB)

( * ) Notice: Subject to any disclaimer, the term of this patent is extended or adjusted under 35 U.S.C. 154(b) by 0 days.

(21) Appl. No.: 10/487,663

(22) PCT Filed: Aug. 21, 2002

(86) PCT No.: PCT/GB02/03851

§ 371 (c)(1),
(2), (4) Date: Aug. 6, 2004

(87) PCT Pub. No.: WO03/019976

PCT Pub. Date: Mar. 6, 2003

(65) Prior Publication Data

US 2005/0053257 A1 Mar. 10, 2005

(30) Foreign Application Priority Data

Aug. 21, 2001 (GB) ..... 0120282.9
Aug. 21, 2001 (GB) ..... 0200315.0

(51) Int. Cl.
*H04R 25/00* (2006.01)

(52) U.S. Cl. ..... 381/152; 381/431

(58) Field of Classification Search ..... 381/301, 381/308, 333–334, 152, 386, 388, 395, 190–191, 381/426–428, 431; 181/169, 172
See application file for complete search history.

(56) References Cited

U.S. PATENT DOCUMENTS

| | | | | |
|---|---|---|---|---|
| 1,778,084 | A | 10/1930 | Nevin | |
| 1,817,630 | A | 8/1931 | Kroesen | |
| 1,919,632 | A * | 7/1933 | Haigis | 381/152 |
| 1,955,682 | A * | 4/1934 | Newmann et al. | 381/152 |
| 5,115,472 | A * | 5/1992 | Park et al. | 381/152 |
| 5,287,413 | A * | 2/1994 | Ashworth | 381/152 |
| 6,332,029 | B1 * | 12/2001 | Azima et al. | 381/152 |
| 6,377,695 | B1 * | 4/2002 | Azima et al. | 381/152 |
| 2003/0147541 | A1 * | 8/2003 | Bachmann et al. | 381/152 |

* cited by examiner

*Primary Examiner*—Suhan Ni
(74) *Attorney, Agent, or Firm*—Jackson Walker, LLP

(57) ABSTRACT

An acoustic device has a suspended sheet of a thin flexible material having a rigid rod secured along one edge. An audio frequency actuator, which is preferably a magnetostrictive actuator, is acoustically coupled to an end face of the rod. The audiofrequency actuator is supplied with an audio signal from an audio source such as player device selected from the group which includes a recording tape player, a CD player, a DVD player, and a solid state memory device.

30 Claims, 3 Drawing Sheets

ACOUSTIC DEVICE

FIELD OF THE INVENTION

This invention relates to an acoustic device, and in particular to a thin panel type of loudspeaker.

BACKGROUND TO THE INVENTION

Flat panel loudspeakers are well-known, and typically consist of a rigid panel of laminated plastics, card or wood with an acoustic transducer attached to one face of the panel. Typical transducers are moving coil electromagnetic devices or piezoelectric devices. On a smaller scale, it has been proposed to attach a transducer to a greetings card to permit the card to deliver an audible message, or music, in addition to the written or printed matter on the card. Devices of this type are disclosed in WO 97/09842, for example.

It has now been found that a flexible sheet material, such as may be used to a make a window blind or the like, may be caused to act as an effective sound radiator.

SUMMARY OF THE INVENTION

According to the invention, there is provided an acoustic device comprising a sheet of a thin flexible material having a rigid elongate member secured thereto, an audio frequency actuator acoustically coupled to the elongate member, and means for supplying the audiofrequency actuator with an audio signal.

The sheet may be suspended from one edge thereof, for example in the manner of a blind.

It will be understood that, while the sheet might conveniently have a generally rectangular shape, for example when used as a blind, the invention is not limited to the use of sheets having any particular shape.

The elongate member may be secured to the sheet by means of adhesive, preferably an inelastic adhesive or the sheet may be secured by any rigid clamping means either against the body of the elongate member or in a groove in the member. Conveniently, the elongate member is attached to the sheet along an edge thereof, suitably the lower edge when the sheet is suspended at one end thereof. For example, the sheet may be formed into a roll at one edge thereof, and the elongate member is then secured within the roll.

The elongate member may be a rod or tube, formed of metal, plastics or a composite material, for example carbon fibre-reinforced plastics material. It will be appreciated that any rigid or inelastic material may be used.

The actuator is preferably a giant magnetostrictive material (GMM) actuator, for example of the type described and claimed in our co-pending International Patent Application PCT/GB01/01184, or as described and claimed in our co-pending application GB0115481.4. Preferably, the actuator is bonded to one end of the elongate member, for example by adhesive or by a screw-threaded connection. Where the elongate member is a tube, the actuator may be bonded to a short rod which is in turn secured within the tube, for example by a non-flexible adhesive.

The elongate member is preferably secured to the lowermost edge of the sheet, the sheet being suspended at its upper edge, but it is also possible for the elongate member to be at the upper edge of the sheet, or at a position intermediate the ends or sides, particularly where the sheet is not rectilinear in form.

The sheet does not have to be held flat. Indeed, in an especially preferred embodiment of the invention, the sheet is suspended in such a manner as to form an end portion of the sheet into a curve. It has been found that this configuration gives an improved bass response. The elongate member need not be straight; it can be curved, for example to form a parabola or other curve, or multiple curves, for example in an 's' shape, so that the sound or improved sound is heard on both sides of the sheet, and this may permit the sound emitted by the sheet to be directed so as to give improved volume and bass response at a particular location. It may be desirable to curve the elongate member in more than one plane, or over only a part of the length thereof.

The elongate member may comprise a body containing the audio frequency actuator and the means for supplying the actuator with an audio signal. The body could also contain a power source for operation of the device, for example one or more dry cells.

It may be desirable for the edge of the sheet by which it is suspended not to be parallel to elongate member particularly where the elongate member is attached to the lowermost edge of the sheet.

The means for supplying the audio signal may comprise a player device for reproducing a recorded audiofrequency signal. For example, the player device may be a recording tape player, a CD player, a DVD player, or a solid state memory device.

Alternatively, the means for supplying the audio signal may comprise a radio receiver or a network receiver, for example a device providing a connection to the Internet. The radio receiver may be a broadcast radio receiver, or a receiver for a locally-radiated radio signal, for example providing a wireless connection from a local signal source.

The thin flexible material of the sheet may be an extruded or otherwise formed plastics sheet material, a woven or non-woven textile material, paper or card, or even metal foil. The material will ideally be such that, when rolled, the material will stand up on the rolled end and be self-supporting, but it could be a combination of a floppy or non-self-supporting material and support strips attached thereto or incorporated therein.

The acoustic device of the invention will be useful for a wide range of applications, from display stands that serve also to radiate sound for audio-visual information or entertainment purposes to blinds that serve as loudspeakers. In one application, a blind is provided which, when pulled down, can be caused to play soothing music for a baby, for example.

Another application for the acoustic device of the invention is in the reduction of noise. By combining with the device a microphone and noise cancellation controller which generates an antiphase signal corresponding to the noise received by the microphone, the device can be employed to reduce perceived noise in a room or just in a part of a room. The noise reduction may be configured to have a broad-spectrum effect or to reduce the amplitude of selected frequency bands, for example frequencies associated with speech. By configuring the device as a roller blind, for example, it can be arranged to activate when the blind is lowered, reducing noise on a selected side of the blind. In this way, for example, a temporary quiet zone could be provided in an open-plan office or the like, without the need for providing relatively high-mass walls around the zone, but just by lowering blinds. Another use for such blinds would be in hospital wards, to provide quieter conditions for a patient without the need for a separate room.

The blind may be provided with two separate layers spaced apart from one another, one carrying a microphone to receive the ambient noise to be reduced, while the other has the GMM actuator supplied with the antiphase signal to reduce the amplitude of the ambient sound in the region of the blind. It will be appreciated that a similar effect can be achieved by a combination of a rigid screen having a microphone associated therewith and a blind in accordance with this aspect of the invention to radiate the cancellation signal. The microphone could be a GMM actuator coupled to the second layer.

Another embodiment of the invention comprises a "flag" formed of a small sheet of a flexible material having sufficient stiffness to retain a curve therein. The flag has a rod attached to it, for example along a vertical edge, or centrally of the width of the flag, the rod being bonded to an actuator, for example a magnetostrictive actuator. The flag can be used to provide local sound output, for example providing an individual choice of music at a restaurant table, or information and announcements at a conference or exhibition.

The flag is preferably formed of thin card, stiffened fabric, metal foil or plastics sheet material, but floppy materials incorporating stiffening supports may be employed. A slightly concave arrangement is preferable, the concave face being directed towards the user, in use, to enhance the sound heard by the user. Alternatively, a shape such as an 's' shape of multiple curves may be employed.

The device may have more than one rod, for example at each side of the flag. Alternatively, the rod may be located centrally of the flag, for example diagonally across the flag, effectively forming two flags on a single support.

The rod may be dimensioned to incorporate therein the actuator, and audio signal generator and batteries to power the device.

The flag could be used to carry advertising material, or perhaps a picture of a musician whose music is played through the device. The flag could be attached to an integral rigid bar which could be mechanically connected to the rod, for example by sliding it into a groove, thereby facilitating replacement of the flag. The flag could be formed as a pullout roll in the rod.

BRIEF DESCRIPTION OF THE DRAWINGS

In the drawings, which are diagrammatic illustrations of exemplary embodiments of the invention.

DETAILED DESCRIPTION OF THE ILLUSTRATED EMBODIMENTS

Figure 1:
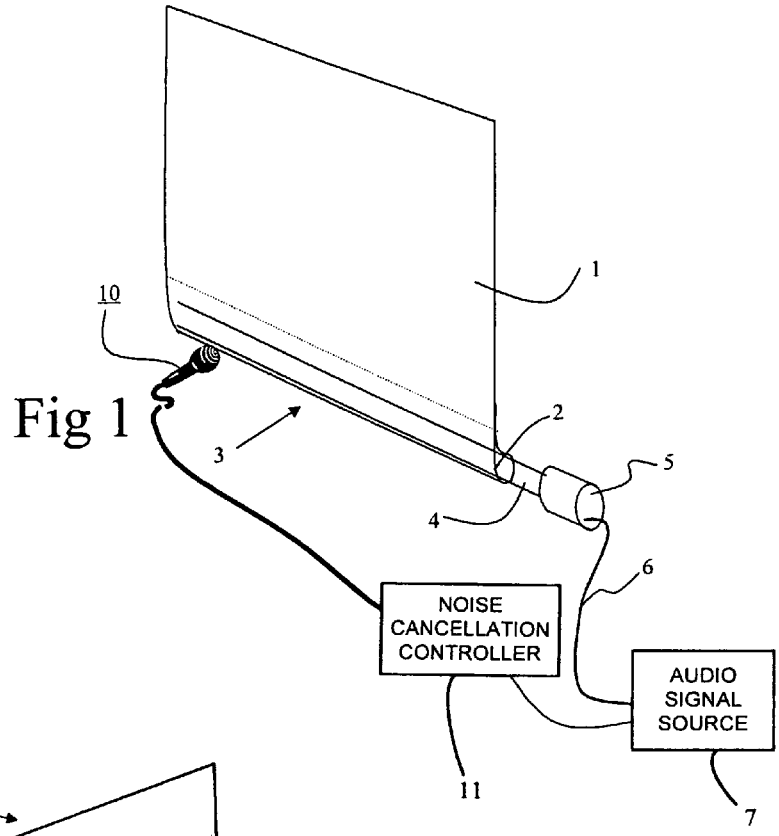
FIG. 1 is a perspective view of the lower end of a blind in accordance with the invention.

Referring first to FIG. 1, the audio device comprises a blind 1 formed of a stiff flexible material suspended from the upper end thereof and formed into a loop 2 at the lower end 3 thereof. A steel rod 4 is secured in the sleeve thus formed by means of a hard-bonded inelastic adhesive, for example a rapid-bonding glue or 'superglue'. A giant magnetostrictive material (GMM) actuator 5, for example of the type disclosed and claimed in our co-pending International patent Application PCT/GB01/01184, is secured via its acoustic coupling "foot" to one end of the rod 4, and is electrically connected to a suitable audio signal source 7 through an electrical lead 6. When an audio signal is applied to the actuator 5, the audio signal is coupled to the blind 1 and is radiated outwardly thereby, effectively causing the blind to become a loudspeaker. In one embodiment, a microphone 10 is linked to a noise cancellation controller 11 which generates an antiphase signal corresponding to the noise received by the microphone 10. This signal can be passed, via the audio signal source 7, to the actuator 5 so that the device can be employed to reduce perceived noise in a room, or just in a part of a room.

Figure 2:
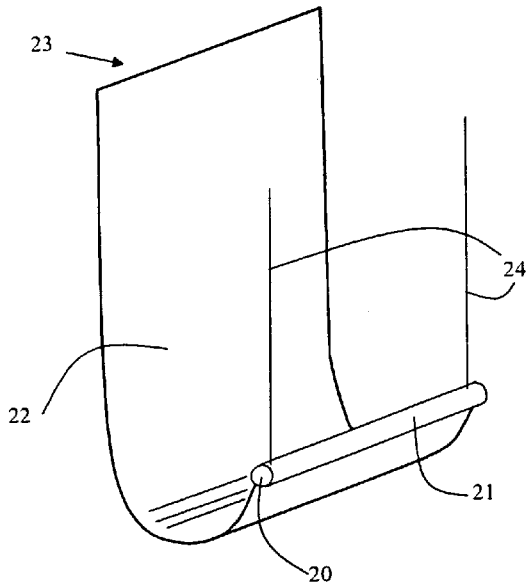
FIG. 2 is a perspective view of a blind according to an alternative embodiment.

FIG. 2 shows an alternative embodiment, in which the rod, the actuator, a battery, a radio receiver and an amplifier are all incorporated into a plastics body 20 which is secured by adhesive in a loop 21, formed by sewing or welding an end portion of the blind 22 back on to itself. The blind 22 is suspended at the opposite end 23 thereof, for example from a ceiling or window opening, and also has cords 24 by which the free end of the blind containing the body 20 is suspended to form the blind into a curve adjacent to the lower end thereof. It has been found that this configuration significantly improves the bass response of the blind when operating as a loudspeaker.

The radio receiver within the body may be arranged to receive broadcast radio, but it may be preferred to use the type of receiver employed in local computer networking or the like, for example that operating under the protocol known as "Bluetooth", relaying, for example, music or speech from a local source such as a connection to the Internet.

In another embodiment, the body 20 incorporates a microphone and noise cancellation circuitry to generate an audio signal of opposite phase to that detected by the microphone within a selected frequency band, the blind then being caused to radiate the opposite signal, thereby cancelling at least some of the ambient noise.

Figure 3:
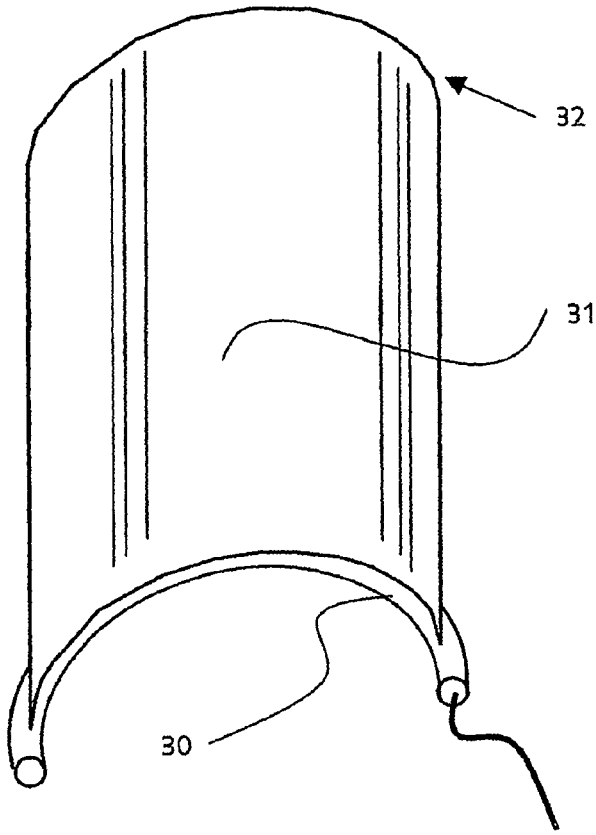
FIG. 3 is a perspective view of a blind according to a further embodiment of the invention.

FIG. 3 illustrates a device in which the rod or tube 30 attached to the lower end of the blind 31 is formed into a curve, thereby forming the blind into a curve in horizontal section. For example, the curve may be parabolic, so as to tend to focus sound emitted by the blind to a position in front of the blind. The upper end 32 of the blind may simply be directly suspended from, for example, cords attached to a suitable horizontal surface such as a ceiling, or it may have a stiffening rod attached thereto, curved into a similar shape to that of the rod or tube 30.

Figure 4:
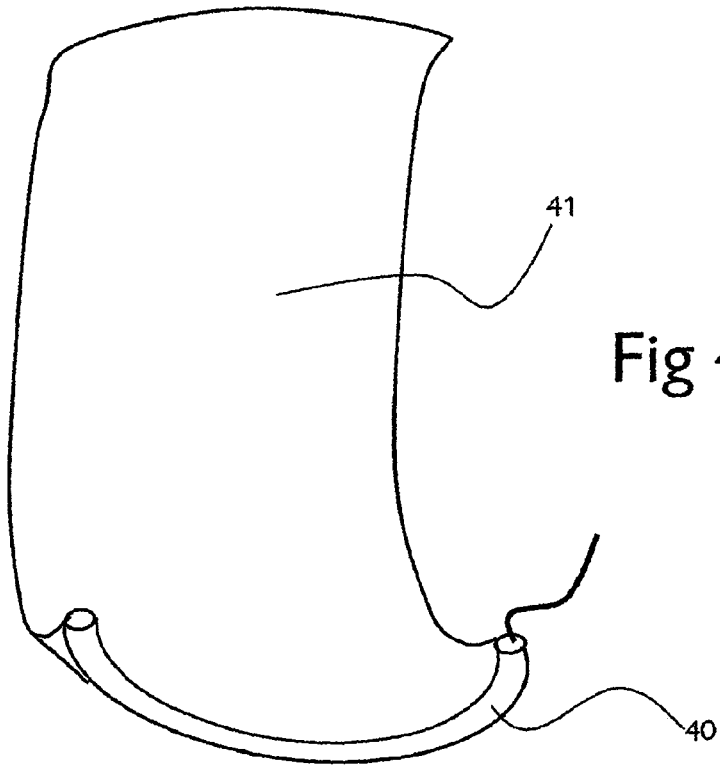
FIG. 4 is a perspective view of yet another embodiment of the invention.

FIG. 4 illustrates another possible configuration, in which the blind 41 is provided with a curved rod 40 attached to the lower end thereof and carrying the magnetostrictive actuator, and is also curved in a vertical plane, so that the blind fabric carries a double curve, tending, for example to focus sound to a location at a predetermined distance in front of the device and at a predetermined height above the ground.

Figure 5:
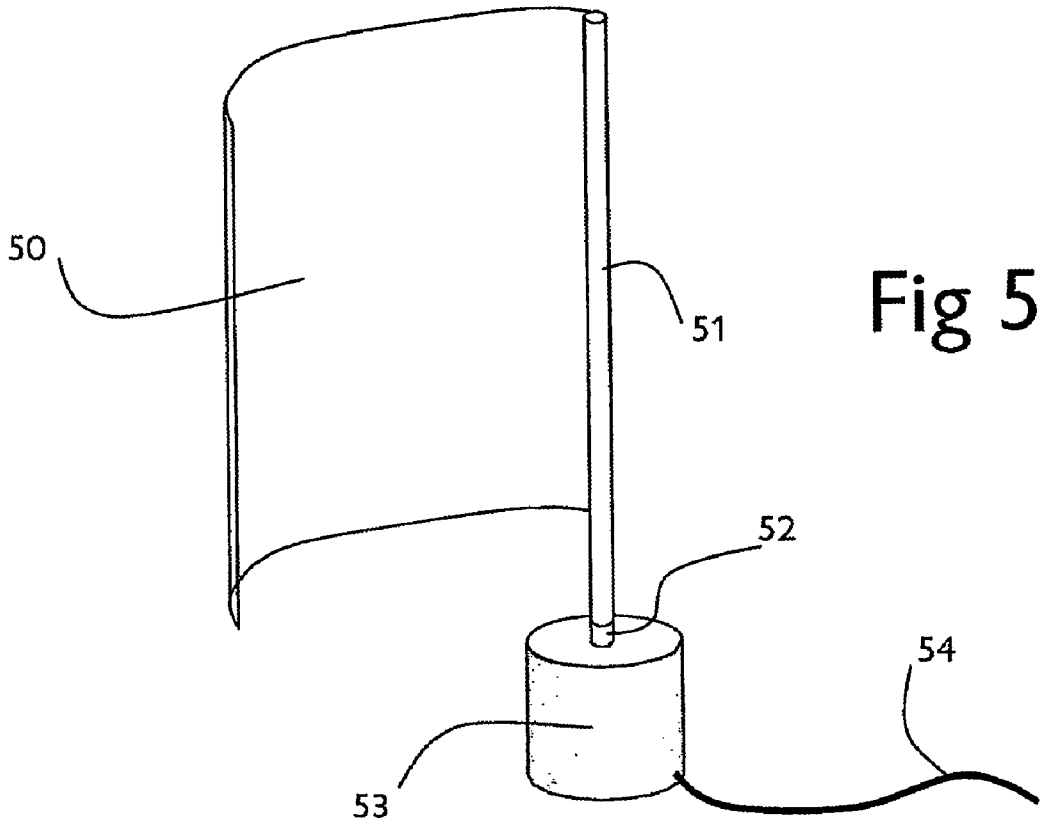
FIG. 5 is a perspective view of an audio device according to another embodiment of the invention.

The device shown in FIG. 5 comprises a "flag" 50 formed of a stiff flexible material such as thin card, stiffened fabric or a plastics sheet material. The flag 50 has sufficient stiffness to be able to hold a slight curve therein. A rigid rod 51, for example of plastics or metal, is attached to the flag by means of an inelastic adhesive material. As shown in the Figure, the rod 51 is attached to a side edge of the flag, but it will be understood that other locations for the rod are also acceptable, for example centrally of the width of the flag. The rod 51 is in turn attached to the active part 52 of a magnetostrictive actuator 53, which is in turn connected through an electrical lead 54 to an audio signal source (not shown). When an audio signal is supplied to the actuator 53, the flag radiates audible sound from the concave face thereof. If the concave face is directed towards a user, the user can then hear the sound.

The invention claimed is:

1. An acoustic device, comprising a sheet of a thin flexible material having a rigid elongate member secured thereto, an audio frequency actuator acoustically coupled to one end face of the elongate member, and means for supplying the audiofrequency actuator with an audio signal.

2. An acoustic device according to claim 1, wherein the elongate member is secured to the sheet by means of adhesive.

3. An acoustic device according to claim 2, wherein the adhesive is an inelastic adhesive.

4. An acoustic device according to claim 1, wherein the elongate member is a metal rod.

5. An acoustic device according to claim 1, wherein the elongate member is formed of a rigid polymeric material or a composite material.

6. An acoustic device according to claim 1, wherein the audio frequency actuator is a giant magnetostrictive material (GMM) actuator.

7. An acoustic device according to claim 1, wherein the actuator is bonded to the end of the elongate member.

8. An acoustic device according to claim 1, wherein means are provided for suspending the sheet from at least one edge thereof.

9. An acoustic device according to claim 8, wherein the sheet is suspended at two opposed ends thereof.

10. An acoustic device according to claim 9, wherein the lowermost end of the sheet is suspended in such a manner as to form an end portion of the sheet into a curve.

11. An acoustic device according to claim 1, wherein the elongate member is secured along an edge of the sheet.

12. An acoustic device according to claim 11, wherein the elongate member is secured to the lowermost edge of the sheet.

13. An acoustic device according to claim 11, wherein the sheet is formed into a roll at one edge thereof, and the elongate member is secured within the roll.

14. An acoustic device according to claim 1, wherein the sheet is supported by the rigid elongate member.

15. An acoustic device according to claim 14, wherein the sheet is sufficiently stiff to hold a curve therein.

16. An acoustic device according to claim 14, wherein the sheet is provided with at least one stiffening support.

17. An acoustic device according to claim 1, wherein the elongate member contains the audio frequency actuator and the means for supplying the actuator with an audio signal.

18. An acoustic device according to claim 17, wherein the player device is selected from the group consisting of a recording tape player, a CD player, a DVD player, and a solid state memory device.

19. An acoustic device according to claim 18, wherein the radio receiver is a broadcast radio receiver.

20. An acoustic device according to claim 18, wherein the radio receiver is a receiver for a locally-radiated radio signal, for example providing a wireless connection from a local signal source.

21. An acoustic device according to claim 1, wherein the means for supplying the audio signal comprises a player device for reproducing a recorded audiofrequency signal.

22. An acoustic device according to claim 1, wherein the means for supplying the audio signal comprises a radio receiver or a network receiver.

23. An acoustic device according to claim 1, wherein the thin flexible material is an extruded plastics sheet material or metal foil.

24. An acoustic device according to claim 1, wherein the thin flexible material is a woven or non-woven textile material.

25. An acoustic device according to claim 1, wherein the thin flexible material is paper or card.

26. An acoustic device according to claim 1, further comprising a microphone directed to one side of the sheet and connected to a noise cancellation circuit for supplying the audiofrequency signal to the actuator, thereby causing the sheet to radiate an opposite signal to at least selected frequencies received by the microphone.

27. An acoustic device according to claim 26, wherein the microphone is attached to a surface spaced from the sheet, the surface receiving the sound to be cancelled.

28. An acoustic device according to claim 27, wherein the surface comprises a second flexible blind.

29. An acoustic device according to claim 27, wherein the surface is a rigid sheet adjacent to the blind.

30. An acoustic device according to claim 29, wherein the rigid sheet is glass.

* * * * *